United States Patent [19]

L'Hermite et al.

[11] 4,108,693

[45] * Aug. 22, 1978

[54] METHOD FOR THE HEAT-TREATMENT OF STEEL AND FOR THE CONTROL OF SAID TREATMENT

[75] Inventors: Mathurin L'Hermite, Versailles; Raymond Le Bossenec, Fontenay-le-Fleury; Pierre Godart, Plaisir; François Pierrard, Versailles, all of France

[73] Assignee: L'Air Liquide, Societe Anonyme pour l'Etude et l'Exploitation des Procedes Georges Claude, Paris, France

[ * ] Notice: The portion of the term of this patent subsequent to Jul. 12, 1994, has been disclaimed.

[21] Appl. No.: 802,521

[22] Filed: Jun. 1, 1977

Related U.S. Application Data

[63] Continuation-in-part of Ser. No. 534,301, Dec. 19, 1974, Pat. No. 4,035,203.

[51] Int. Cl.[2] ..... C21D 1/48

[52] U.S. Cl. ..... 148/16.5; 148/16.6; 148/20.3

[58] Field of Search ..... 148/16, 16.5, 16.6, 148/20.3

[56] References Cited

U.S. PATENT DOCUMENTS

| | | | |
|---|---|---|---|
| 3,058,815 | 10/1962 | Davis | 148/16.5 |
| 3,356,541 | 12/1967 | Cullen | 148/16.5 |
| 3,413,161 | 11/1968 | Goehring | 148/16.5 |
| 3,693,409 | 9/1972 | Yamagishi | 148/16.5 |
| 3,705,058 | 12/1972 | Kolozsyari | 148/16.6 |
| 3,748,195 | 7/1973 | Kondo et al. | 148/16.5 |
| 3,790,413 | 2/1974 | Kanetake | 148/16.5 |
| 3,870,572 | 3/1975 | Brugger et al. | 148/16.6 |
| 4,035,203 | 7/1977 | L'Hermite et al. | 148/16.5 |

FOREIGN PATENT DOCUMENTS

| | | | |
|---|---|---|---|
| 1,578,942 | 8/1969 | France | 148/16.5 |
| 1,156,180 | 6/1969 | United Kingdom | 148/16.5 |

*Primary Examiner*—R. Dean

*Attorney, Agent, or Firm*—Lee C. Robinson, Jr.

[57] ABSTRACT

The invention relates to a method of and an installation for the heat treatment of steels, such as heating before hardening, annealing, and carburization, which heat treatment is carried out in a furnace in the presence of a protection or carbon-enrichment atmosphere which flows continuously through the furnace, the atmosphere being obtained by the mixture, before its introduction into the furnace, of a carrier gas including nitrogen and possibly hydrogen, and an active gas constituted by a hydrocarbon, the mixture containing at least 0.2% by volume of hydrocarbon.

The active gas may be constituted by ethylene, ethane or acetylene and the treatment is carried out at a temperature between 850° and 1050° C.

The installation includes a device for analyzing the atmosphere at the furnace outlet, this analyzer actuating a regulating valve for the inlet flow of active gas through a servo-mechanism, in dependence on the proportion of carbon in the treated steel.

7 Claims, 9 Drawing Figures

METHOD FOR THE HEAT-TREATMENT OF STEEL AND FOR THE CONTROL OF SAID TREATMENT

Figure 1:
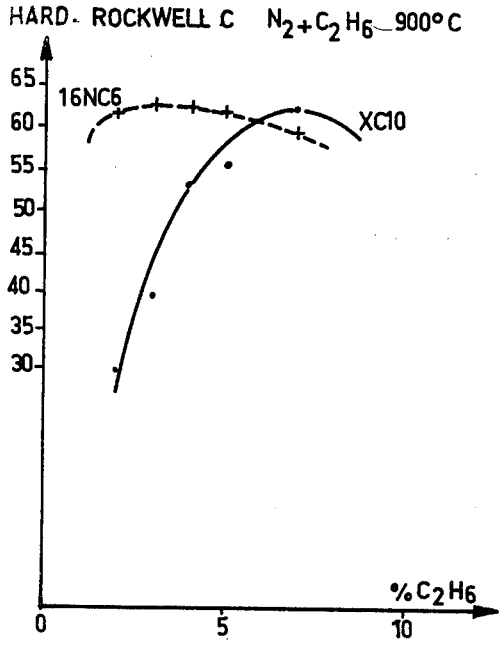
Figure 2:
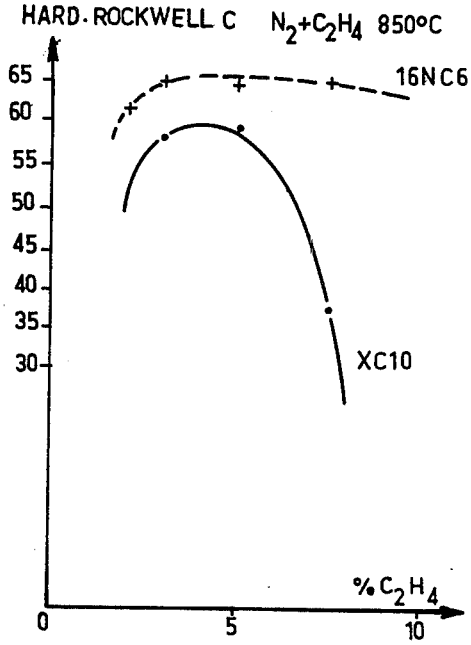
Figure 3:
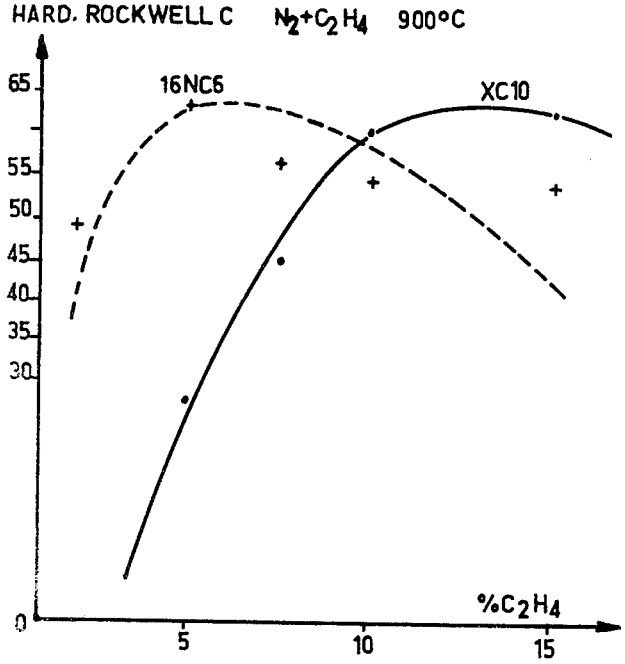
Figure 4:
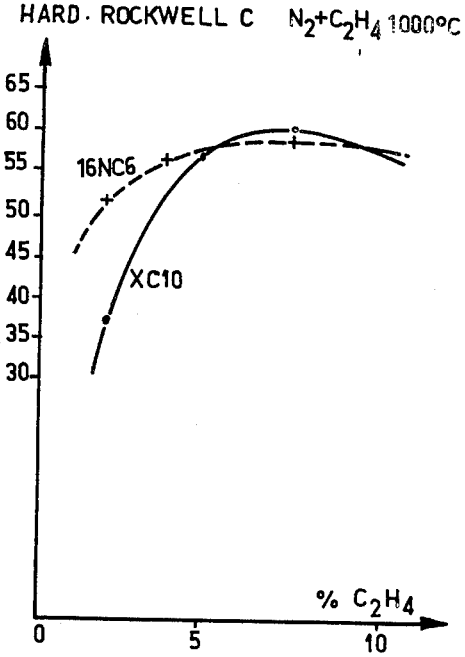
Figure 5:
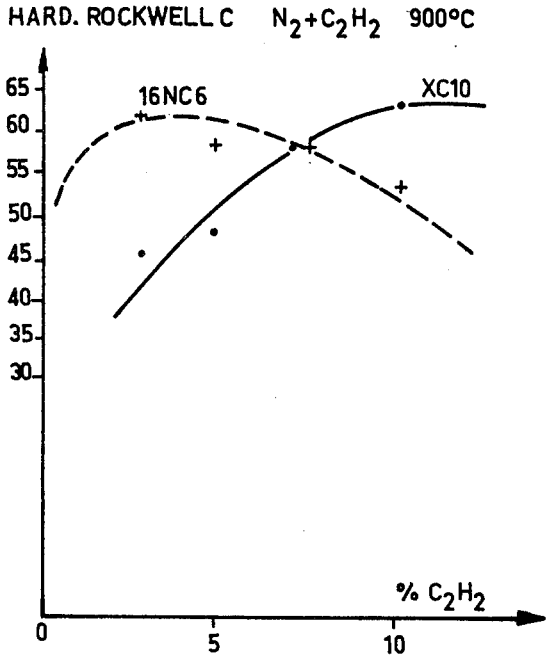
Figure 6:
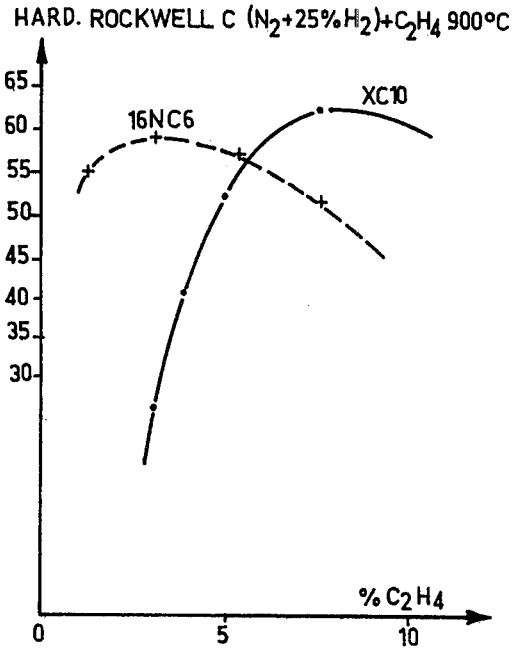
Figure 7:
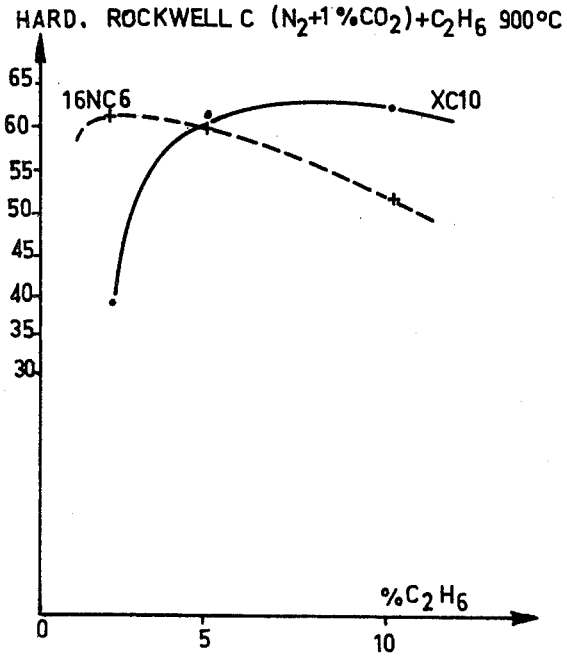
Figure 8:
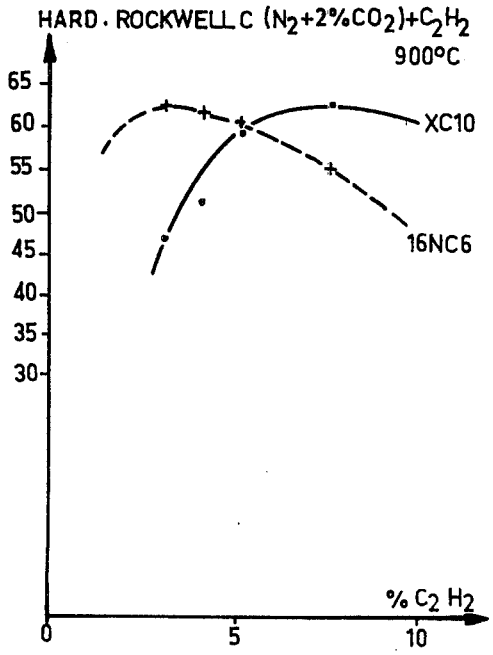

This is a continuation-in-part of copending application Ser. No. 534,301, filed Dec. 19, 1974, now U.S. Pat. No. 4,035,203 granted July 12, 1977.

The present invention essentially relates to a method of heat treatment of steel, such as heating before hardening, annealing, or carburization, carried out in a furnace in the presence of a protection or carbon-enrichment atmosphere. The atmosphere flows continuously in the furnace and is obtained by mixing, prior to introducing the atmosphere into the furnace, a carrier gas including hydrogen and possibly nitrogen, and an active gas constituted by a hydrocarbon, the mixture containing at least 0.2% by volume of hydrocarbon.

It is known that the use of protecting or enrichment atmospheres, known as controlled atmospheres, for the heat treatment of steels makes it possible either to maintain the surface condition of the metal or to modify the surface composition of the metal. As to the latter, the surface composition of the metal can be modified by the addition of certain constituents, such as carbon, for example by carburization or by case-hardening by carbon.

According to the method of treatment described in French Pat. No. 1,578,942, there is essentially employed as the protection or carburization atmosphere, a mixture of nitrogen and propane. Tests made within the framework of this known method have shown that the nitrogen could contain substantial quantities of hydrogen and the propane could be replaced by natural gas or another hydrocarbon. However, it is not clear what proportions of the constituents of the carrier gas of this atmosphere should be used or what the specific nature of the hydrocarbons which can constitute the active gas of this atmosphere should be. Furthermore, the carrying into practice of this known method is associated with certain difficulties, in particular the existence on the treated parts of deposits of soot which adversely affects the quality of the finished product.

Another difficulty attending this known method is that the carburant activity (or carbon potential) of the atmosphere cannot be controlled or regulated with sufficient accuracy. This probably is because this method relies on an empirical technique for the carburant activity, so that the production of a case-hardened steel having predetermined characteristics or the achievement of a total absence of de-carburization results from a more or less long series of trial and error operations and is not reasonably assured.

There is also known a method of carburization of steels at 1,000° C. wherein the parts to be treated are placed in a chamber under vacuum, and then natural gas is introduced into the chamber at a controlled pressure. However, this method has the disadvantage of requiring complicated and costly installations.

The present invention has for its object to overcome the above-mentioned drawbacks of the known methods, especially by deepening and widening the study of the method already known from the above-mentioned French patent.

This object is attained by forming a protection or enrichment atmosphere from mixing a carrier gas with a hydrocarbon chosen from one of the following compounds: $C_2H_4$, $C_2H_6$, $C_2H_2$, the proportion by volume of hydrocarbon being greater than 0.2% and reaching up to 30%, and by heating the steel to be treated to a temperature between 850° and 1050° C.

Experience has shown that the utilization of these specifically chosen hydrocarbons under the conditions of temperature indicated, reduces considerably the deposition of soot, such soot being eliminated even at temperatures higher than 950° C. Also, carburization can be achieved at temperatures in the neighborhood of 1,000° C. without having recourse to vacuum techniques. Although some prior techniques have used an atmosphere containing aliphatic or aromatic hydrocarbons, such techniques have been limited to a relatively low temperature range of 550° to 750° C. and were concerned with carbo-nitriding, thus requiring the presence of ammonia gas. Accordingly, the carburized depth which could be achieved by following such techniques is much less than the carburized depth which is achieved by the present invention. Other techniques have been concerned with carburizing, but have used methane for enriching the carrier gas as opposed to the above-mentioned hydrocarbons. Also, these techniques do not appear to utilize the particular volumes of constituents in the protection atmosphere which have been described above and by which the method of the present invention achieves improved results.

According to another characteristic feature of the invention, in the case where the carrier gas comprises a mixture of nitrogen and hydrogen, the hydrogen may be present in an amount up to 30% by volume of the mixture.

According to still another characteristic feature of the invention, the carrier gas may further comprise 0 to 2% by volume of $CO_2$.

The present invention also relates to a method of controlling the heat treatment of steel, carried out in a furnace in the presence of an atmosphere obtained by the mixture of a carrier gas and an active gas constituted by a hydrocarbon. In accordance with this method, the residual content of hydrocarbon in the atmosphere passing out of the furnace is measured and is compared to a predetermined hydrocarbon content level. Since the relation between the residual content hydrocarbon and the quantities of carbon introduced into the steel can be determined and represented graphically, the quantity of hydrocarbon of the atmosphere passing into the furnace which is necessary to obtain the quantity of carbon desired thus can be ascertained, and the proportion of hydrocarbon in that introduced atmosphere is regulated so as to result in the desired residual content level at the outlet of the furnace.

In some previously suggested heat treatment techniques, process control is attempted by measuring carbon potential which requires a relatively complex system, relies on fragile sensing elements and, in some instances, is dependent upon complicated calculations. However, by the control method described herein, the heat treatment may be effected in a systematic manner so as to obtain a final product having the desired characteristics, while avoiding the trial and error and hazardous methods previously known.

The present invention also relates to the steels obtained by the above-mentioned method.

Figure 9:
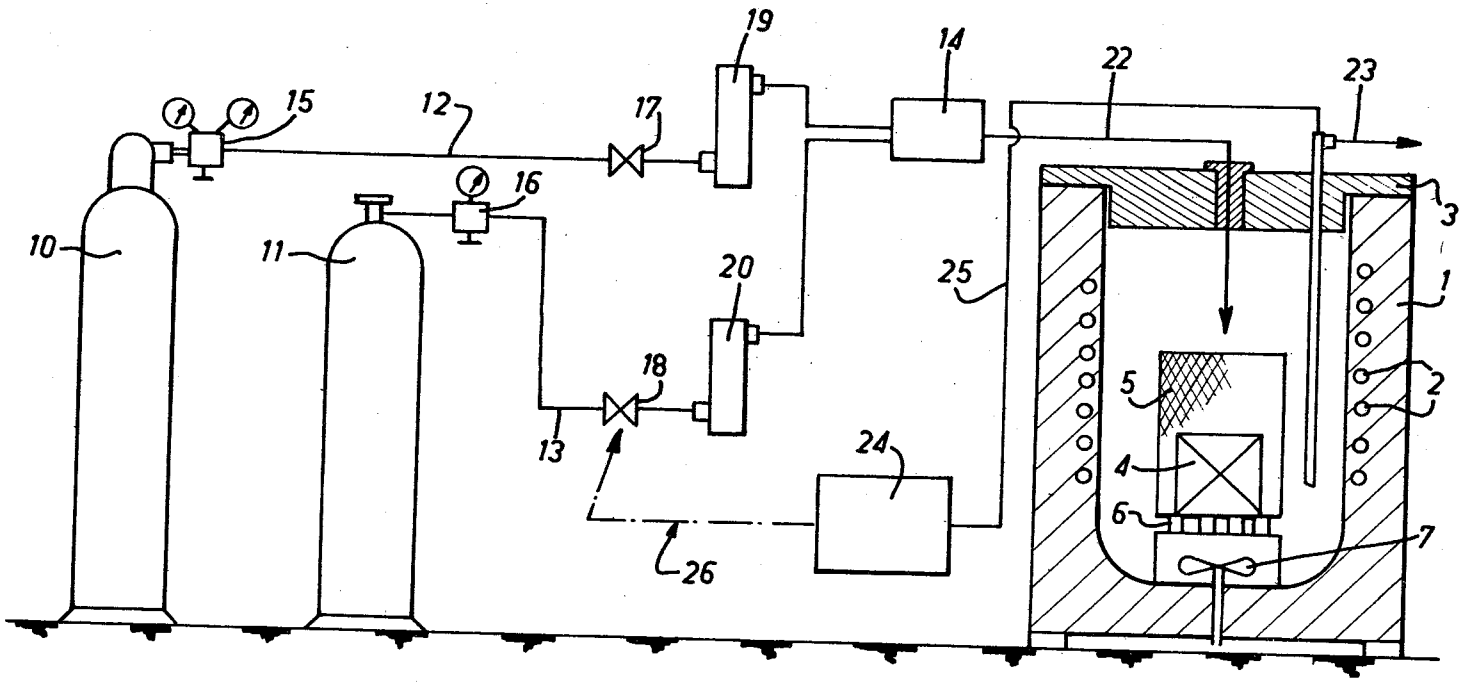

Other characteristic features and advantages of the invention will become apparent from the description which follows below, reference being made to the accompanying drawings, given by way of non-restrictive example, and in which:

FIGS. 1-8 are graphical representations of the relation between the hardness of steels and the hydrocarbon content of the protection atmosphere used in the method of the invention; and FIG. 9 is a schematic diagram of an installation for carrying into effect the method according to the invention.

The controlled atmospheres for the heat treatment of steels function essentially either to prevent oxidation and surface decarburization during heating before hardening or annealing, or to incorporate in the steels a certain quantity of carbon while at the same time also preventing oxidation. Hence, the atmospheres use mixtures comprising gases that are inactive with respect to the steel at the treatment temperatures, such as nitrogen, and active gases which are capable of yielding carbon directly. These controlled atmospheres are introduced at a constant flow-rate into a treatment chamber, for example the hearth of an annealing or case-hardening furnace.

Tests carried out on carrier or diluent gases, which up to the present time were constituted essentially either by nitrogen alone or by mixtures of nitrogen and hydrogen, the proportions of which were in no way defined with accuracy, have shown that in the case of nitrogen-hydrogen, these proportions could not be indefinite. It has been determined that the percentage by volume of hydrogen must be between 0 and 30%. The addition of hydrogen in the above-mentioned proportions to the nitrogen improves the surface condition of the steels which are treated, especially for treatment temperatures of between 950° and 1050° C.

Tests have also shown that it is advantageous to incorporate in carrier gases a small proportion of carbon dioxide. In particular, the addition of 0 to 2% by volume of $CO_2$ to the nitrogen enables the quality of the parts which are treated to be considerably improved, especially for treatment temperatures between 850° and 950° C.

Furthermore, tests carried out on the active gases have shown that the nature and the percentage of the hydrocarbons giving the best results vary according to the treatment temperature, the nature of this treatment and the grade of steel to be treated.

Amongst the hydrocarbons which had been employed up to the present time, it has been decided to choose ethane $C_2H_6$, ethylene $C_2H_4$ and acetylene $C_2H_2$. The use of these hydrocarbons reduces considerably or even eliminates deposits of soot on the treated parts.

As regards the preferred temperatures of treatment it has been found that these temperatures, for practically all steels, could be located between 850° and 1050° C. It has been found that acetylene in a proportion by volume of between 0.2 and 12% gives particularly advantageous results.

The controlled atmospheres according to the invention have also made it possible to effect case-hardening with carbon at between 850° and 1050° C. under the best conditions, that is to say practically without deposit of soot. Carburization of steel has been effected by utilizing $C_2H_6$ or $C_2H_4$ with a proportion by volume between 0.2 and 12% and a temperature of between 850° and 1050° C. The particular use of a mixture of nitrogen and ethylene with 8% by volume of ethylene enables operation at a temperature in the vicinity of 1000° C. The atmospheres according to the invention thus make it possible, by working at a high temperature, to reduce considerably the duration of the treatment without having recourse to vacuum techniques.

The above-mentioned atmospheres may also be employed, in addition to the case of cementation by systematic case-hardening with carbon, whenever any decarburization is to be feared, especially in the general case of annealing, and in particular of globulization annealing of steels and heating before hardening.

In order to be able to check and control the carburizing activity of carbon potential of the controlled atmospheres with sufficient accuracy, and so as to obtain in consequence a fixed product having definite characteristics, it is desirable to measure accurately the percentage of hydrocarbons contained in the atmosphere passing out of the treatment chamber, and therefore to control the addition of hydrocarbons to the carrier gas at the inlet of the treatment chamber.

This control is effected according to the invention as a function of the residual composition of the atmosphere passing out of the furnace. It has been found that by analyzing the atmosphere passing out of the furnace, the carburizing activity or carbon potential of that atmosphere can be determined and monitored. Graphs were therefore prepared which represent the relation between the residual content of hydrocarbon, for example of $C_2H_4$, at the outlet of the furnace and the carbon introduced into the steel.

By utilizing these graphs, the carbon potential can be controlled or regulated by regulating the addition of the hydrocarbon to the atmosphere admitted to the inlet of the furnace, as a function of the residual content of this hydrocarbon in the atmosphere passing out of the furnace. This measurement of the residual content of hydrocarbon can be effected by conventional methods, such as chromatography, spectrometry, etc. The flow-rate of the hydrocarbon then may be controlled directly as a function of the measured value of the residual content.

There will be given below examples of the method of treatment according to this invention and the manner in which this method is controlled.

Steel parts of grades XC 10and case-hardening steel of grades 16 NC 6 (AFNOR Standard) were carburized for 4 hours at different temperatures in a furnace of the "well" type provided with stirring means, by means of atmospheres constituted by a mixture of $N_2$ an hydrocarbon or by a mixture of $N_2$ and an hydrocarbon and further including hydrogen or carbon dioxide.

These atmospheres and temperatures were as follows:

| tests | atmosphere composition | temperature |
|---|---|---|
| A | $N_2 + C_2H_6$ | 900° C |
| B | $N_2 + C_2H_4$ | 850° C |
| C | $N_2 + C_2H_4$ | 900° C |
| D | $N_2 + C_2H_4$ | 1.000° C |
| E | $N_2 + C_2H_2$ | 900° C |
| F | $(N_2 + 25\% H_2) + C_2H_4$ | 900° C |
| G | $(N_2 + 1\% CO_2) + C_2H_6$ | 900° C |
| H | $(N_2 + 2\% CO_2) + C_2H_2$ | 900° C |

Measurements of the Rockwell hardness made on parts oil-hardened after carburization enables the plotting of the hardness of the steel in the form of curves as a function of the percentage of hydrocarbon. These curves, which then can be used as standards to determine hardness, shown by a solid line in FIG. 1 to 8 for the XC 10 steel and by a broken line for the 16 NC 6 steel, illustrate that maximum hardness is obtained for variable contents of hydrocarbon according to the grade of the steel. For example, in the case of test A (FIG. 1), the maximum hardness (62.5 Rockwell C) is obtained for:

3 to 4% by volume of $C_2H_6$ for 16 NC 6;

7% by volume of $C_2H_6$ for XC 10.

At the outlet of the furnace, the residual hydrocarbon content for this maximum hardness is 0.5% for 16 NC 6 and 2.3.% for XC 10.

Measurement made on these treated parts showed that the depths carburized followed the laws of diffusion in the same manner as in the case of previous methods.

Referring now to FIG. 9, a controlled heat-treatment installation according to the invention is illustrated as comprising a furnace 1 of the "well" type of refractory material lined internally with a jacketing of steel, provided with heating resistances 2 and closed by a cover 3.

The steel part to be treated, shown in the form of a block 4, is placed inside the furnace in a basket 5 or the like which rests on a grid 6 below which is located a rotary agitator 7, the function of which is to stir continuously the furnace atmosphere.

Two receptacles 10 and 11 are provided, wherein receptacle 10 contains the carrier gas and receptacle 11 contains the active gas (these gases being stored in gaseous or liquid form). These gases are supplied to a mixer 14 through the intermediary of conduits 12 and 13, respectively. Each conduit is provided with a pressure-reducing valve 15 and 16, respectively, a valve 17 and 18, respectively, and a flow-meter 19 and 20, respectively. The mixer 14 supplies a controlled atmosphere continuously to furnace 1 through a conduit 22, this atmosphere being evacuated from the furnace through a conduit 23, also in a continuous manner.

The installation further comprises a gas analyzer 24 connected through a conduit 25 to the evacuation conduit 23. This analyzer is provided with or cooperates with a servo-mechanism shown diagrammatically at 26, which is controlled in dependence upon the residual content of hydrocarbon, measured by the analyzer, such as against a predetermined or reference hydrocarbon content level, and which actuates the valve 18 in such manner as to vary the flow-rate of the hydrocarbon and therefore the proportion of this hydrocarbon in the mixture admitted to the furnace.

There is thus obtained an automatic regulation of the carbon potential of the atmosphere, which makes it possible, in the example of case-hardening, to obtain a steel having definite characteristics, and in the case of annealing heating or heating before hardening, to maintain the steel in its initial condition, that it to say, to prevent any surface carburization or de-carburization.

While the present invention has been particularly shown and described with reference to preferred embodiments, it should be readily apparent that various changes and modifications in form and details can be made without departing from the spirit and scope of the invention, and it is intended that the appended claims be interpreted as including such changes and modifications.

What is claimed is:

1. A method of heat treatment of steel which comprises the steps of mixing a nitrogen-containing carrier gas and an active gas including a hydrocarbon selected from the group consisting of the compounds $C_2H_4$, $C_2H_2$ and $C_2H_6$, the mixture containing between 0.2% and 12% by volume of hydrocarbon, continuously introducing the thus formed mixture into a furnace containing the steel to be heat-treated to provide an atmosphere consisting substantially entirely of said mixture around the steel, heating the steel and the surrounding atmosphere to a temperature within the range of from 850° C. to 1050° C., continuously withdrawing the atmosphere from said furnace, measuring the residual content of hydrocarbon in the atmosphere withdrawn from said furnace, comparing the thus measured residual hydrocarbon content with a predetermined hydrocarbon content level to ascertain the proportion of carbon in the steel, and regulating the flow rate of hydrocarbon in the atmosphere being introduced into the furnace to provide a residual hydrocarbon content corresponding to the desired proportion of carbon in the steel.

2. A method as claimed in claim 1, in which the carrier gas of said atmosphere comprises a mixture of nitrogen and hydrogen, and in which the hydrogen is present in said mixture in a percentage up to 30% by volume.

3. A method as claimed in claim 1, in which said carrier gas comprises carbon dioxide in a percentage between 0 and 2% by volume.

4. A method as claimed in claim 1, in which $C_2H_2$ is utilized for the active gas of said atmosphere.

5. A method as claimed in claim 1, in which $C_2H_4$ is utilized as the active gas of said atmosphere.

6. A method as claimed in claim 5, in which said atmosphere comprises a mixture of $N_2$ and $C_2H_4$ in a proportion by volume of 8%, and in which the steel is brought up to a temperature in the vicinity of 1000° C.

7. A method as claimed in claim 1 in which $C_2H_6$ is utilized as the active gas of said atmosphere.

* * * * *